US011180352B2

(12) United States Patent
Stoof et al.

(10) Patent No.: US 11,180,352 B2
(45) Date of Patent: Nov. 23, 2021

(54) CRANE COMPRISING FIRST MAST WITH TILTABLE FIRST MAST UPPER PART

(71) Applicant: Mammoet Engineering B.V., Schiedam (NL)

(72) Inventors: Pieter Maria Stoof, Breda (NL); Wessel Helmens, Stolwijk (NL); Anton Adrian Joachim Van Den Broek, Rijen (NL)

(73) Assignee: Mammoet Engineering B.V., Schiedam (NL)

( * ) Notice: Subject to any disclaimer, the term of this patent is extended or adjusted under 35 U.S.C. 154(b) by 73 days.

(21) Appl. No.: 16/643,775

(22) PCT Filed: Sep. 7, 2018

(86) PCT No.: PCT/NL2018/050578
§ 371 (c)(1),
(2) Date: Mar. 2, 2020

(87) PCT Pub. No.: WO2019/050404
PCT Pub. Date: Mar. 14, 2019

(65) Prior Publication Data

US 2020/0216294 A1 Jul. 9, 2020

(30) Foreign Application Priority Data

Sep. 8, 2017 (NL) ..... 2019511

(51) Int. Cl.
*B66C 23/82* (2006.01)
*B66C 23/70* (2006.01)
(Continued)

(52) U.S. Cl.
CPC ..... *B66C 23/82* (2013.01); *B66C 23/702* (2013.01); *B66C 23/36* (2013.01); *B66C 23/66* (2013.01); *B66C 23/68* (2013.01); *B66C 23/76* (2013.01)

(58) Field of Classification Search
CPC ..... B66C 23/42; B66C 23/62; B66C 23/64; B66C 23/68; B66C 23/70; B66C 23/82
See application file for complete search history.

(56) References Cited

U.S. PATENT DOCUMENTS 3,085,695 A * 4/1963 Miller ..... E02F 9/14 212/300
5,842,587 A * 12/1998 Wanek ..... B66C 23/82 212/177
(Continued)

FOREIGN PATENT DOCUMENTS

DE 29624267 U1 6/2001
DE 202004002424 U1 7/2005
(Continued)

OTHER PUBLICATIONS

Search Report issued in counterpart Netherlands Application No. 2019511, dated Jan. 20, 2018.
(Continued)

*Primary Examiner* — Michael R Mansen
*Assistant Examiner* — Juan J Campos, Jr.
(74) *Attorney, Agent, or Firm* — Blank Rome LLP

(57) ABSTRACT

Provided is a crane with a main boom and a back mast, of which at least one comprises a first mast upper part comprising at least one mast section and a first mast lower part comprising at least one mast section, and a first mast tilting. The first mast tilting member is arranged between the first mast upper part and the first mast lower part, and has a straight hoisting state wherein the first mast upper part and the first mast lower part are essentially in line with each
(Continued)

other, and a tilted hoisting state wherein the first mast upper part is tilted with respect to the first mast lower part.

23 Claims, 7 Drawing Sheets

(51) Int. Cl.

| | |
|---|---|
| ***B66C 23/68*** | (2006.01) |
| *B66C 23/36* | (2006.01) |
| *B66C 23/66* | (2006.01) |
| *B66C 23/76* | (2006.01) |

(56) References Cited

U.S. PATENT DOCUMENTS

| | | | | |
|---|---|---|---|---|
| 8,640,896 | B2 * | 2/2014 | Martin | B66C 23/68 212/300 |
| 2018/0346290 | A1 * | 12/2018 | Brueckner | B66C 23/42 |
| 2019/0218075 | A1 * | 7/2019 | Woldring | B66C 23/708 |

FOREIGN PATENT DOCUMENTS

| | | | |
|---|---|---|---|
| EP | 0048076 | A1 | 3/1982 |
| NL | 1032105 | C1 | 1/2008 |

OTHER PUBLICATIONS

International Search Report and Written Opinion issued in counterpart International Application No. PCT/NL2018/050578, dated Jan. 3, 2019.

* cited by examiner

CRANE COMPRISING FIRST MAST WITH TILTABLE FIRST MAST UPPER PART

FIELD OF THE DISCLOSURE

The invention pertains to the field of hoisting cranes, preferably cranes having a first mast and a second mast.

BACKGROUND OF THE DISCLOSURE

In the field large cranes for hoisting heavy loads often operate on locations where there is relatively little space available. Cranes comprising a straight main boom and a straight back mast are well suited for such of applications, as they require relatively little space for the assembling and are able to hoist heavy loads. For example, the cranes disclosed in WO 2016/133389 A2 can be assembled vertically, which requires very little space.

However, it may happen that for one or more hoisting jobs on a certain site the horizontal reaching span of such crane is insufficient. This may be resolved by choosing a larger crane or by rebuilding the crane on another position, which are costly and/or time consuming measures. Furthermore, it is also possible that a construction, e.g. a building, prevents the main boom from being tilted further. Therefore, a need exists for expanding the horizontal reaching span of a crane comprising a straight main boom.

The back mast of a crane is used to balance the weight of the load that is to be hoisted, usually with a ballast weight or counterweight. The further the distance of the ballast weight to the middle of the crane is, the larger the weight of the load can be. In general a straight back mast is used. However, the achievable distance with straight back mast is limited, even more if the angle of the back mast with the horizontal is limited on the location, e.g. because of surrounding buildings or other constructions. Therefore, a need exists for expanding the distance of the ballast weight to the middle of the crane.

SUMMARY OF THE DISCLOSURE

It is an object of the invention to address at least one of the issues mentioned above.

Therefore, there is provided a crane, which crane comprises:

a crane base, a first mast, which is pivotable about a first pivot which is arranged at the crane base and has a horizontal pivot axis, which first mast comprises a plurality of mast sections, wherein the first mast is the main boom, a second mast, wherein the second mast is the back mast, wherein the first mast comprises a first mast tilting member which is arranged between two mast sections, thereby defining a first mast upper part and the first mast lower part of the first mast, wherein the first mast upper part comprises at least one mast section and is arranged between the first mast tilting member and an upper end of the first mast, the first mast lower part comprises at least one mast section and is arranged between the crane base and the first mast tilting member, and the first mast tilting member comprises an upper connection part connected to the first mast upper part and a lower connection part connected to the first mast lower part, has a straight hoisting state wherein the first mast upper part and the first mast lower part are essentially in line with each other, and a tilted hoisting state wherein the first mast upper part is tilted with respect to the first mast lower part and away from the second mast, is adapted to transfer forces from the first mast upper part to the first mast lower part in both the straight hoisting state and the tilted hoisting state.

The invention also pertains to a crane, which crane comprises:

a crane base, a first mast, which first mast comprises a plurality of mast sections, wherein the first mast is the back mast, a second mast, which is pivotable about a first pivot which is arranged at the crane base and has a horizontal pivot axis, wherein the second mast is the main boom, wherein the first mast comprises a first mast tilting member which is arranged between two mast sections, thereby defining a first mast upper part and the first mast lower part of the first mast, wherein the first mast upper part comprises at least one mast section and is arranged between the first mast tilting member and an upper end of the first mast, the first mast lower part comprises at least one mast section and is arranged between the crane base and the first mast tilting member, and the first mast tilting member comprises an upper connection part connected to the first mast upper part and a lower connection part connected to the first mast lower part, has a straight hoisting state wherein the first mast upper part and the first mast lower part are essentially in line with each other, and a tilted hoisting state wherein the first mast upper part is tilted with respect to the first mast lower part and away from the second mast, is adapted to transfer forces from the first mast upper part to the first mast lower part in both the straight hoisting state and the tilted hoisting state.

According to the invention, a crane comprising a crane base is provided. The crane base supports the crane. It can be any type of known crane base, e.g. the chassis of a crawler crane, and/or a foot assembly of a ringer crane. The crane base can also be a part of a boat or be on a boat. The crane base can be revolving. The crane base can be arranged on a support surface of the working area. The support surface is for example part of the ground which is provided with loose steel plates for better consistency. The crane base optionally comprises rollers and/or slide shoes. Optionally, the crane base can absorb both pushing forces and pulling forces from the masts of the crane. Optionally, the crane base comprises multiple outriggers, e.g. at least three outriggers, optionally more than three outriggers.

The crane further comprises a first mast. The first mast is either a back mast or a main boom. The first mast further comprises a plurality of mast sections. Optionally, each mast section is individually assembled on site at the hoisting location from separate tubes and/or beams, which are for example connected to each other by pin-hole connections. The beams can have any suitable cross sectional shape, for example square, rectangular, round, triangular or pentagonal. Optionally, the first mast is a lattice mast. Optionally, the first mast has an A-shape, H-shape or a Y-shape. Optionally, the first mast comprises two or more masts, for example parallel to each other.

The crane further comprises a second mast. The second mast is the other one of a back mast and a main boom. Thus, if the first mast is a main boom, then the second mast is a back mast. If the first mast is a back mast, then the second mast is a main boom.

The main boom is pivotable about a first pivot, which is located at the crane base and has a horizontal pivot axis.

Optionally, the back mast is pivotable about a second pivot, which is located at the crane base and has a horizontal pivot axis. Optionally, the first pivot and the second pivot coincide.

Optionally, the second mast is a lattice mast. Optionally, the second mast is a telescopic mast. Optionally, the second mast has an A-shape, H-shape or a Y-shape. Optionally, the second mast comprises two or more masts, for example parallel to each other.

Thus, a crane according to the invention comprises a main boom and a back mast. The crane is adapted to hoist loads with the main boom, for which the main boom may for example comprise a hoisting mechanism with a main hoisting wire, to which a load can be attached. The back mast has the function of balancing the main boom and/or the load, for example with a ballast weight. The main boom is pivotable, and optionally the back mast is also pivotable, which allows to bring them in a desired angle with an imaginary horizontal axis, such that the load can be hoisted. Furthermore, at least the main boom is usually able to rotate about a vertical axis, such that the load can be transferred to another location. Optionally, the main hoisting wire of the hoisting mechanism is at an upper end of the main boom, and the main boom comprises only a main hoisting wire to hoist loads, meaning that there is no auxiliary hoisting wire.

In the context of this invention, in general "horizontal" means essentially parallel with a ground surface, and "vertical" means essentially perpendicular to the ground surface. However, it is envisaged that the crane base may be tilted or on an uneven ground surface, in which case the horizontal and vertical may deviate from the above definitions.

According to the invention, the first mast comprises a first mast tilting member, which is arranged between two mast sections. As such, the first mast tilting member divides the first mast in a first mast upper part and a first mast lower part. The first mast upper part comprises at least one mast section and is arranged between the first mast tilting member and an upper end of the first mast. The first mast lower part comprises at least one mast section and is arranged between the crane base and the first mast tilting member.

It is noted that the at least one mast section comprised by the first mast upper part, can in the case the first mast is the main boom be a small part of the mast comprising the hoisting mechanism. Thus, if the first mast is a lattice boom, said mast section does not necessarily need to be a lattice section, although that is possible. Similarly, if the first mast is the back mast, said mast section can comprise the upper part where for example a guywire is attached, which guywire connects the main boom and the back mast.

It is further noted that the at least one mast section comprised by the first mast lower part may be adapted to be connected to the crane base, and therefore be different and possibly smaller than most of the other mast sections of the first mast.

In the context of this invention, the terms "upper" and "lower" are meant in function of the direction that the particular mast or other component extends, starting from the crane base. Thus, "lower" means closer to the crane base, and "upper" means further from the crane base. In most normal working conditions, "lower" will correspond with closer to the ground surface, and "upper" will correspond with further from the ground surface, however, this is dependent on the positions of the particular mast or component.

The first mast tilting member comprises an upper connection part connected to the first mast upper part and a lower connection part connected to the first mast lower part. Thus, the first mast tilting member is arranged between the first mast upper part and the first mast lower part, and is connected to both. The connection between the first mast tilting member and the first mast upper part and/or first mast lower part, may be accomplished by any suitable connection method. Optionally, the connection method is a detachable mechanical connection. Optionally, the connection method is the same as applied to connect the mast section to each other. Optionally, the connection method includes pin-hole connections. Preferably, the first mast lower part is connected to the first mast tilting member using the same method as for the first mast upper part, but this is not essential for the invention. Optionally, the first mast tilting member comprises tubes and/or beams that are made out of stronger or thicker profiles than the tubes and/or beams used in the first mast lower part and/or first mast upper part.

According to the invention, the first mast tilting member has at least two hoisting configurations, wherein the orientation of the first mast upper part relative to the first mast lower part is different in the first hoisting configuration relative to the second hoisting configuration. The first hoisting configuration is a straight hoisting state. In the straight hoisting state, the first mast upper part and the first mast lower part are essentially in line with each other. Thus, the first mast in essentially straight, which corresponds with the working state of a first mast of a conventional crane. The crane is adapted to hoist loads when the first mast tilting member is in the straight hoisting state. During the hoisting, the first mast tilting member transfers the forces absorbed by the first mast from the first mast upper part to the first mast lower part. In this context, essentially in line with each other means that the first mast upper part and the first mast lower part are intended to be in line, although in practice of course there may be small deviations, e.g. due to forces generated by a load that is being hoisted. If they are in line, central axis of both would be parallel. Thus, essentially in line may for example mean that those central axes deviate from being parallel by 15 degrees or less, or optionally 10 degrees or less, or optionally 5 degrees or less.

The second hoisting configuration is a tilted hoisting state. In the tilted hoisting state, the first mast upper part is tilted with respect to the first mast lower part and away from the second mast. Thus, the first mast upper part and the first mast lower part are not essentially in line, and the first mast is not essentially straight. By tilting the first mast upper part relative to the first mast lower part, the first mast upper part can extend in a direction that is more horizontal as the first mast lower part. The first mast upper part can thus be arranged more horizontal as compared to the straight hoisting state. As such, the horizontal reaching span of the first mast is larger in the tilted hoisting state than it is in the straight hoisting state. The crane is adapted to hoist loads when the first mast tilting member is in the tilted hoisting state. Just as in the straight hoisting state, the first mast tilting member transfers forces from the first mast upper part to the first mast lower part that are absorbed by the first mast during hoisting.

As can be seen, the first mast tilting member allows expanding the horizontal reaching span of a first mast, when the first mast tilting member is moved into in the tilted hoisting state. When the first mast is the main boom, this allows for hoisting loads from or to locations that are further away from the crane base, for example when a surrounding building prevents the complete main boom from being tilted more horizontal. In that case, the first mast lower part can extend far enough upwards, such that the first mast upper part extends over the building.

When the first mast is a back mast, the ballast weight can be arranged further away. This increases the effect of the ballast weight and as such allows for a heavier load to be hoisted with the main boom.

Note that the first mast is also adapted to perform hoisting operations in the straight hoisting state. As such, a crane according to the invention gives the user more flexibility in hoisting operations, and makes the crane suitable for a wider range of hoisting jobs, for which traditionally multiple and/or bigger cranes would be needed. Thus, a crane according to the invention saves cost and time as compared to traditional cranes. It also allows to only tilt the first mast upper part relative to the first mast lower part when it is needed.

Furthermore, a crane according to the invention allows to assemble the first mast while it is essentially straight, and only tilt the first mast upper part to the first mast lower part when the first mast is in a vertical assembled position. This simplifies the construction of the crane, and is especially advantageous when there is little space available, which may not allow the assembling of a tilted mast.

In a possible embodiment of a crane according to the invention, the first mast tilting member is adapted to be brought from the straight hoisting state to the tilting hoisting state, and/or vice versa, while a load is attached and being lifted with the hoisting mechanism of the main boom.

For example, when the first mast is the main boom, a load can be lifted while the first mast tilting member is in the straight hoisting state, and the main boom is essentially straight. While the load is being hoisted and in the air, the first mast tilting member can be brought into the tilted hoisting state. Such an embodiment increases the flexibility of the crane considerably, since the locations where any load can be hoisted from and to increase considerably. This is especially advantageous when there is relatively little free space to maneuver at the hoisting site, for example because of surrounding buildings or other structures.

In a possible embodiment of a crane according to the invention, a cross section of the mast section of the first mast upper part that is connected to the first mast tilting member is of the same dimensions as a cross section of the mast section of the first mast lower part that is connected to the first mast tilting member. Optionally, all of the mast section of the first mast upper part have a cross section of the same dimensions as the mast section of the first mast lower part, or all mast sections except the mast section that is connected to the crane base and/or the one that is connected to the hoisting mechanism when the first mast is the main boom. Optionally, said mast sections do not only have the same cross sectional dimensions, but they are identical to each other.

Thus, in this embodiment, when the first mast tilting member is in the straight hoisting state, the first mast is very similar to a conventional crane which does not comprise the first mast tilting member, and therefore cannot be tilted. Hence, the first mast will function similar to such a conventional crane, and also be able to hoist load similarly to a conventional crane when in the straight hoisting state. Furthermore, the first mast upper part being of the same cross sectional dimensions as the first mast lower part means that the first mast upper part can absorb forces of the same order of magnitude as the first mast lower part. In the case the first mast is the main boom, this allows to have the main hoisting wire at the upper end of the first mast upper part. The main hoisting wire is the wire with which loads of maximum weight can be lifted. Since the main hoisting wire is arranged at the upper end of the main boom, an auxiliary hoisting wire is no longer required, and can therefore optionally be omitted.

In a possible embodiment, at least one of the first mast and the second mast is a lattice mast.

In a possible embodiment, both the first mast and the second mast are lattice mast.

Optionally, the first mast and/or second mast comprise one or more mast sections which comprises four corner tubes which corner tubes all have an octagonal cross section. Alternatively, another number of corner tubes, or corner tubes with other cross sections may be used.

The octagonal cross sectional shape is advantageous with respect to bending stiffness and resistance to buckling. It also allows an easy connection to for example diagonal bracings which connect two corner tubes to each other due to the flat outer surfaces which are at a relative angle of 45°.

In a possible embodiment of a crane according to the invention, multiple of the plurality of mast sections of the first mast, and the upper connection part and the lower connection part of the first mast tilting member, are adapted such that the first mast tilting member can be arranged between any two of the concerned mast sections. For example, all of the concerned mast sections may have similar upper and lower connections parts, which are similar to the upper connection part and the lower connection part of the first mast tilting member respectively. It is also possible that the upper connection parts of the mast sections are also similar to the lower connection parts, and the upper connection part of the first mast tilting member is similar to the lower connection part. However, the upper connection part and the lower connection part of the first mast tilting member could also be adapted such that they can be connected to multiple kinds of mast sections, with non-similar connection parts. For example, if pin-hole connection are used, the upper connection part and the lower connection part of the first mast tilting member may comprises adaptor parts with multiple arrangements of holes suitable for connection with different mast sections.

In this embodiment, the first mast tilting member may be arranged in multiple locations in the first mast. Each different location results in a different length of the first mast lower part and/or the first mast upper part. Depending on the chosen location, both the horizontal and vertical reaching span of the first mast may differ, and the division of forces in the crane may differ as well. Thus, during the construction, the first mast tilting member can be arranged on the location that is most advantageous for the hoisting jobs that the crane is supposed to perform. Furthermore, in case it turns out after delivery or even assembling of the first mast that another location of the first mast tilting member is more suitable, this can still be achieved with the same first mast and same first mast tilting member. There is no need to bring a new crane to the location, which would be a costly and time-consuming operation. Thus, the crane according to this embodiment increases the flexibility, and thereby reduces time and cost.

In a possible embodiment of a crane according to the invention, a cross section of the mast section of the first mast upper part that is connected to the first mast tilting member is smaller than a cross section of the mast section of the first mast lower part that is connected to the first mast tilting member.

In a possible embodiment of a crane according to the invention, a cross section of the mast section of the first mast upper part that is connected to the first mast tilting member is bigger than a cross section of the mast section of the first mast lower part that is connected to the first mast tilting member.

In a possible embodiment of a crane according to the invention, the first mast tilting member may be designed such that tilting further than a predetermined angle is prevented, for example because parts of the first mast tilting member come into contact with each other and as such are prevented from moving further. Said predetermined angle may correspond with the tilted hoisting state, but it can also be a further tilted position that is not used during normal operation, such that it functions as a back-up safety mechanism. This embodiment prevents the first mast upper part from tilting too much, which could result in a dangerous situation.

In a possible embodiment of a crane according to the invention, the crane further comprises a strut. The strut has a first strut end which is in contact with the first mast. This may for example be to the first mast upper part, the first mast lower part, or the first mast tilting member. The strut further has a second strut end which is attached to a first strut guywire. The first strut guywire in turn is attached to the upper end of the first mast upper part for keeping the first mast upper part in a fixed position relative to the first mast lower part when the first mast tilting member is in the tilted hoisting state.

Thus, the strut is attached to the upper end of the first mast upper part with a guywire. In the tilted hoisting state the first strut guywire is tensioned. The tensioned guywire prevents the first mast upper end from moving further away relative to the strut. Hence, the first mast upper part cannot tilt further with respect to the first mast lower part, and the first mast upper part is kept safely in the tilted position. Normally, the strut must only prevent the first mast upper part from tilting further, since gravity prevents the first mast upper part from moving back towards the position wherein the first mast upper part is in line with the first mast lower part.

Optionally, and if needed, the crane can comprise multiple struts, for example two or three. This may beneficial for the division of the forces due to the hoisting of the load. Thus, multiple struts may be arranged on the first mast. Optionally, the multiple struts each have a first end that is arranged at the first mast, wherein the first ends are in each other's vicinity at the first mast, for example at the first mast tilting member. Optionally, the second end of a one of the struts is connected to the second end of another of the struts by means of a guywire, and the second end of the latter strut is connected to an upper end of the first mast upper part by the first strut guywire.

It is noted that in context to this inventions, when any kind of wire of guywire is described, in practice this may actually include a plurality of guywires that follow essentially the same routing.

In a possible embodiment of a crane according to the invention wherein the crane comprises the strut, the crane further comprises a second strut guywire. The second strut guywire is attached to the second end of the strut, as well as to the first mast lower part or the crane base. The crane further comprises a winch for winding one of the first strut guywire and the second strut guywire. The winch may for example be located in the upper end of the first mast upper part, or close to or at the crane base or ground level. It also possible that the winch is located close or at the crane base, wherein the first strut guywire extends to that location from the upper end of the first mast upper part, for example parallel to the first mast. That is, the first strut guywire is extends from the strut towards the upper end of the first mast upper part, where a sheave holds the first strut guywire and adjusts its routing so that the first strut guywire extends further downwards parallel to the first mast.

In this embodiment, when the first mast tilting member is in the tilted hoisting state, a distance between the second end of the strut and the upper end of the first mast upper part is determined by the first strut guywire, which is connected to both the second end of the strut and the upper end of the first mast upper part. Furthermore, a distance between the second end of the strut and the crane first mast lower part and/or crane base is determined by the second strut guywire.

The first mast upper part is then adapted to be moved in line with the first mast lower part to bring the first mast tilting member into the straight hoisting state, by winding one of the first strut guywire and the second strut guywire on the winch, optionally while keeping the length of the other one of the first strut guywire and the second strut guywire constant.

For example, the first strut guywire can be winded on the winch, while the second strut guywire has a length that is kept constant, for example because it is fixed or by preventing it from winding on or off another winch. The first strut guywire is attached to the strut and the first mast upper part, during hoisting to keep the first mast upper part locked in a fixed position relative to the first mast lower part. However, by winding the first strut guywire on the winch, the first strut guywire becomes shorter. Since the strut is fixed relative to the first mast lower part, the upper end of the first mast upper part is forced to move closer to the strut. Eventually, the first mast upper part will be in line with the first mast lower part. In this position, the first mast tilting member can be brought back into the straight hoisting state.

It is also possible that the first strut guywire has a constant length, and the second strut guywire is wound up on the winch. In this case, the distance from the second end of the strut to the upper end of the first mast upper part is kept constant, while the distance between the second end of the strut and the first mast lower part is decreased, thereby moving the first mast upper part in line with the first mast lower part.

It is also possible that both the first strut guywire and the second strut guywire can be wound on separate winches at the same time.

In a possible embodiment wherein the crane comprises the strut, the strut has a functional position for keeping the first mast upper part in a fixed position relative to the first mast lower part when the first mast tilting member is in the tilted hoisting state, and a non-functional position wherein it is essentially parallel with the first mast lower part and wherein the first end of the strut is located above the second end, the crane comprises a winch for winding a guywire which is attached to the strut, which is adapted to subject the strut to an upwards movement by winding the guywire on the winch, wherein said guywire optionally is the first strut guywire, the first mast lower part has a strut guide for guiding the strut parallel to the first mast lower part during the upwards movement, and the first mast further comprises a strut positioning element, which is adapted to stop the upwards movement of the strut and force the strut to pivot, until the strut is in the functional position.

The strut has a functional position and a non-functional position. In the functional position, the strut keeps the first mast upper part in a fixed position relative to the first mast lower part when the first mast tilting member is in the tilted hoisting state. Thus, in the functional position, the first end of the strut is connected to the first mast and the first strut guywire is tensioned. In the non-functional position, the strut is essentially parallel with the first mast lower part. In this position, the first end of the strut is above the second end. In this context, above is seen in the direction that the first mast extends, wherein above means further away from the crane base. Thus, if the first strut guywire is attached when the strut is in the non-functional position, it is to the lower end, i.e. the second end, of the strut. Since the strut is only needed when the first mast tilting member is in the tilted hoisting state, the strut may be in the non-functional position when the first mast tilting member is in the straight hoisting state.

In this embodiment, the crane comprises a winch for winding a guywire which is attached to the strut. Said guywire can for example be the first strut guywire, but it is envisaged that it could also be another guywire. The winch may for example be located in the upper end of the first mast upper part. It also possible that the winch is located close or at the crane base, wherein the guywire extends to that location from the upper end of the first mast upper part, for example parallel to the first mast. The guywire is adapted to be subject the strut to an upwards movement. This upwards movement is achieved by winding the guywire on the winch. By this winding, the part of the guywire that is attached to the strut is pulled upwards in the direction of the upper end of the first mast upper part. As such, the strut is subjected to a pulling force and pulled upwards.

The first mast lower part has a strut guide. The strut guide may be arranged on the mast sections, but it is also possible that an outer surface of the mast sections as such functions as the strut guide. The strut guide guides the strut during the upwards movement, such that the first mast moves parallel to the first mast lower part.

The first mast further comprises a strut positioning element. The first mast positioning component is adapted to stop the upwards movement of the strut, when the first end of the strut comes into contact with the strut positioning element. However, the strut positioning element is adapted to allow a rotation of the strut. The strut positioning element is adapted to bring the strut in the functional position.

The strut positioning element can be located at the first mast lower part, the first mast tilting member or the first mast upper part. It may be a protrusion extending from the first mast or a component attached to the first mast. For example, it may be a fork that catches the first end of the first strut element. Optionally, a pin is inserted in a hole of the strut before the pivoting movement. For example, pin may be controlled by a hydraulic cylinder.

Optionally, the strut positioning element comprises a strut locking component for locking the strut in the functional position.

Optionally, the guywire still subjects the strut to a pulling force on the second end of the strut, which is located below the first end. The combination of the pulling force and the strut positioning element force the strut to pivot about a pivoting point located at the strut positioning element. Finally, the strut reaches the functional positions.

Thus, in this embodiment the strut is brought from the non-functional position into the functional position, by winding the guywire on the winch. The winding of the guywire accomplished an upwards pulling force on the strut, which causes the strut to be moved in a direction parallel to the first mast lower part while being guided by the strut guide. The upwards movement of the strut eventually comes to an end when the strut meets the strut positioning element. The strut positioning element is adapted such that the strut will pivot due to the pulling force rather than move upwards. As such, the strut comes into the functional position.

Optionally, the strut positioning element has a fork-like shape. The fork-like shape can have an opening between two protrusions that extend downwards, wherein the strut can be received in the opening. The upwards movement of the strut is stopped when the strut reached the upper end of the movement. The strut also comprises an opening. This opening is arranged such that when the strut pivots, the opening surrounds one of the protrusions of the fork-like shape. As such, the pivoting movement of the strut is enabled.

Optionally, the strut positioning element comprises an extendable cylinder, for example a hydraulic cylinder. By extending and/or retracting, the extendable cylinder subjects the strut to a force which brings it in the functional position.

It will be appreciated by the skilled person that the above embodiments related to the strut can be used for any crane with a strut, and are not limited to a crane according to the invention. This embodiment is especially advantageous for cranes that have to be assembled where little space is available. In conventional cranes, the strut is assembled in a position wherein it extends from the first mast, often in a more or less horizontal direction. The crane according to the present embodiment allows for the strut to be parallel to the first mast, until it reaches the strut positioning element. This can be arranged to be above surrounding buildings or other constructions, where more space is available. Furthermore, this embodiment is advantageous because the strut can be brought into the functional position after the crane is assembled, and only when it is needed. Thus, this allows for faster assembling of the crane without the strut and more flexibility. Also, if it was not envisaged at the moment of assembling that the strut would be needed, this embodiment allows to still bring the strut in working position without having to disassemble the first mast.

In a possible embodiment of a crane according to the invention, the second strut guywire has a fixed length. The length is adapted to maintain the strut in the functional position.

Thus, the length of the second strut guywire is such that the strut is maintained in the functional position. For example, the length is such that the strut cannot move further upwards or pivot more due to the pulling force subject to it by the first strut guywire.

In a possible embodiment of a crane according to the invention, the first mast tilting member further comprises an extendable cylinder, which is adapted to move the first mast tilting member from the straight hoisting state to the tilted hoisting state. Optionally, the extendable cylinder is essentially adapted to force a small movement of the first mast upper part, which initiates the tilting. As such, the extendable cylinder allows to control the tilting of the first mast upper part. Once the tilting is initiated, the remaining tilting may be accomplished by using gravity. The extendable cylinder may for example be a hydraulic or pneumatic cylinder.

The extendable cylinder can be arranged directly between the first mast upper part and the first mast part, such that it transfers forces from the first mast upper part to the first mast lower part in the straight hoisting state. However, it is also possible that the extendable cylinder is connected to a hinge to which also one or more bars are connected, or to a bar that is connected to a hinge. The one or more bars can in turn be connected to the first mast upper part and the first mast lower part, and transfer forces from the first mast upper part to the first mast lower part, e.g. when the first mast tilting member is in the straight hoisting state. By extending or retracting, the extendable cylinder causes the one or more bars to move relative to the hinge, which initiates the tilting.

In a possible embodiment, the first mast tilting member is in the straight hoisting state when the extendable cylinder is extended and in the tilted hoisting state when the extendable cylinder is retracted. Thus, the extendable cylinder when extended prevents the first mast upper part from tilting. By retracting the extendable cylinder, a small pulling force is subjected to the first mast upper part which causes the first mast upper part starts to start tilting. The first mast upper part tilts further due to gravity.

In a possible embodiment, the first mast tilting member is in the straight hoisting state when the extendable cylinder is retracted and in the tilted hoisting state when the extendable cylinder is extended. Thus, in this embodiment the extendable cylinder essentially gives the first mast upper part a small push to start the tilting, by extending from the retracted state to the extended state.

Optionally, when the first mast tilting member is in the tilted hoisting state, or at least when a load is attached to the main boom while the first mast tilting member is in the tilted hoisting state, the extendable cylinder optionally is unpressurized. That is, there is substantially no internal hydraulic pressure in the cylinder. As a result thereof, very little forces, or even none at all, are transferred from the first mast upper part to the first mast lower part via the extendable cylinder. Preferably, the forces are transferred through rigid components, which preferably are symmetric relative to the neutral axis or neutral plane of the first mast and/or first mast tilting member, for example a hinge. In case the extendable cylinder would transfer considerable forces, the whole system could become hyper static, meaning that the division of the forces could become unknown and unpredictable.

Optionally, the extendable cylinder has multiple positions along its range of extending on which it can be locked, such that each position corresponds with a different angle of tilting of the first mast tilting member.

Optionally, a stopping piece is provided. When the extendable cylinder is in the retracted position, the stopping piece extends above the extendable cylinder, such that the first mast upper part essentially leans on the stop rather than the extendable cylinder.

In a possible embodiment of a crane according to the invention, the second mast is connected to the first mast by a second mast guywire. Via the second mast guywire, at least a part of the weight of the load and/or the first mast is carried by the second mast. In this embodiment, the second mast guywire is connected to the first mast at an upper end of the first mast upper part. Thus, the second mast carries the part of the weight of the load directly from the upper end of the first mast upper part, meaning that smaller forces must be carried by the first mast upper part, the first mast tilting members, and/or the first mast lower part. Calculations have shown that the forces carried by all parts of the mast, including the second mast guywire, are considerably lower in this embodiment as compared to when the second mast guywire would be attached to first mast in the vicinity of the first mast tilting member.

In a possible embodiment of a crane according to the invention, the length of the second mast is longer than the length of the first mast lower part. This is beneficial for the balance of the crane. A longer back mast is able to carry more forces, meaning that a heavier load can be lifted with the crane.

In a possible embodiment of a crane according to the invention, the length of the back mast is longer than 50% of the length of the main boom, optionally wherein the length of the back mast is longer than 75% of the length of the main boom, optionally wherein the length of the back mast is approximately equal to the length of the main boom.

In a possible embodiment, the length of the main boom is 120 meter.

In a possible embodiment, the length of the back mast is 60 meter.

In a possible embodiment, the back mast is longer than the main boom.

In a possible embodiment of a crane according to the invention, the first mast tilting member has a tilting axis over which the first mast upper part is tilted relative to the first mast lower part, wherein the tilting axis is located in the proximity of a neutral plane of first mast.

In this embodiment, the tilting part is such that the tilting is done on in neutral plane, which is advantageous for the distribution of the forces in the main boom, and as such for the stress and strain. The neutral plane is an imaginary plane in the cross section seen in the length of the main boom along which there are no longitudinal stresses or strains. It is dependent of the construction of the first mast. For example, if on one side of the first mast stronger components are used, the neutral plane will be located closer to this side rather than in the middle. It is noted that the first mast does not need to be in a rectangular shape, but can also be, for example, triangular or pentagonal shape. Theoretically it is preferred that the tilting axis is located in or substantially in the neutral plane, however, it is envisaged that due to practical considerations concerning the geometry and ability of tilting of the first mast tilting part this is not always achievable.

Preferably, a hinge is provided on the tilting axis, and essentially all forces are transferred from the first mast upper part to the first mast lower part via the hinge. Thus, the forces are transferred on the neutral plane, which is beneficial for the distribution of the forces, an also reduces the bending moment in the first mast, and thereby the stress and strain in the components of the main boom.

In a possible embodiment, the central axis of the main boom is located in the neutral plane, for example when the main boom has a symmetrical cross section. In this case, the tilting axis is located in the center of a cross section of the first mast tilting member as seen in the direction perpendicular on the tilting axis.

In this embodiment, the tilting axis is essentially located in the middle of the cross section of the first mast tilting member. Again, preferably essentially all forces are transferred via the hinge located on the tilting axis. Thus, the forces are distributed symmetrically, which is beneficial for the stress and strain in the components of the main boom.

In a possible embodiment of a crane according to the invention, the crane is a type of crane that is adapted to be assembled vertically. Examples and methods for assembling a crane vertically can for example be found in patent application WO 2016/133389 A2 or the not yet published Dutch patent application NL 2018785, both of which are herein incorporated by reference in its entirely. These cranes are usually used in locations with very limited space, for example a petrochemical plant. The method applied for assembling these cranes may not allow to build a tilted mast, or there might not be sufficient space to build a mast that is already tilted. Therefore, it is especially advantageous to combine the method for assembling vertically with the crane according to the present invention, since it allows to build the first mast vertically when very limited space is available, and even use it vertically as long as needed. Only when a further horizontal reaching span is needed, the first mast upper part must be tilted.

In a possible embodiment of a crane according to the invention, the first mast tilting member comprises a first upper part locking device. The first upper part locking device is adapted to, when the first mast tilting member is in the straight hoisting state, lock the first mast upper part in a fixed position relative to the first mast lower part. As such, the first upper part locking device prevents that the first mast upper part moves with respect to the first mast lower part during hoisting, thereby improving the safety. The first upper part locking device may for example be accomplished by a mechanical locking system. For example, the first mast tilting member may comprise several bars, some having at least one hole, wherein in the straight hoisting state the bars are arranged such that a pin can be arranged though the holes, thereby locking the first mast upper part in a fixed position relative to the first mast lower part. The first mast upper part will therefore stay essentially in line with the first mast lower part, also during hoisting of a load.

In a possible embodiment of a crane according to the invention, the first upper part locking device comprises an extendable cylinder, for example a hydraulic or pneumatic cylinder. The first part upper part locking device is arranged such that the first mast upper part is locked in a fixed position relative to the first mast lower part when the hydraulic cylinder is in the extended state, and the first mast upper part is movable relative to the first mast lower part when the hydraulic cylinder is in the retracted state, or vice versa.

For example, the extendable cylinder may extend into a hole of the first mast tilting member, essentially forming a pin to a pin-hole connection. Alternatively, the extendable cylinder may be attached to a mechanical locking part, for example a pin of a pin-hole connection, which is brought into the locking position when the extendable cylinder either extends or retract. Optionally, the extendable cylinder can be operated to extend and retract from a distance, for example by an operator on the ground. This enables to control the first upper part locking device from the ground, which is faster. Furthermore, it eliminates the need for an operator to climb the first mast for unlocking the first upper part locking device, which may be a dangerous operation.

In a possible embodiment of a crane according to the invention, the second mast also comprises a plurality of mast sections, wherein the second mast comprises

- a second mast upper part comprising at least one mast section,
- a second mast lower part comprising at least one mast section, and
- a second mast tilting member, wherein the second mast tilting member
  - is arranged between the second mast upper part and the second mast lower part, and comprises an upper connection part connected to the second mast upper part and a lower connection part connected to the second mast lower part,
  - has a straight hoisting state wherein the second mast upper part and the second mast lower part are essentially in line with each other, and a tilted hoisting state wherein the second mast upper part is tilted with respect to the second mast lower part and away from the first mast,
  - is adapted to transfer forces from the second mast upper part to the second mast lower part in both the straight hoisting state and the tilted hoisting state.

In this embodiment, the second mast can be tilted, similarly to the first mast. The tilting of the second mast can be accomplished according to the same principles and embodiments as the tilting of the first mast. Thus, the second mast may also have a second mast strut with a first strut guywire for locking the second mast upper part in the tilted hoisting state, it may have the same or different dimensioned cross section in the second mast upper part and second mast lower part, it may comprise an extendable cylinder, it may comprise a second upper part locking device, etc.

In this embodiment, both the main boom and the back mast can be tilted, and it is tilted in the direction away from the first mast. Thus, the first mast and second mast tilt in opposite directions. So, the horizontal reaching span of the main boom is extended, meaning that loads can be hoisted on or to a further distance of the crane base. The further the distance of the load is from the crane base, the larger the moment caused by it. The horizontal reaching span of the back mast is also increased, which increases the moment of the ballast weight, meaning that heavier loads can be hoisted in a certain position of the main boom. The increased leverage of the ballast weight can be used to balance the increased moment caused by increased distance of the load. As such, it can be ensured that the main boom can still achieve the maximum capacity in the tilted hoisting state.

As explained above, the embodiment for positioning the strut can also be applied for cranes that do not have a tilting part according to the invention, or even to cranes without a back mast. Therefore, the invention further pertains to a crane comprising a mast with a strut,

- wherein the strut has
  - a functional position wherein a first end of the strut is connected to the mast and a second end of the strut is connected to a strut guywire, which optionally is attached to an upper end of the mast, and
  - a non-functional position wherein it is essentially parallel with the mast and wherein the first end of the strut is located above the second end,
- wherein the crane comprises a strut guywire winch for winding the strut guywire, which is adapted to subject the strut to an upwards movement by winding the strut guywire on the strut guywire winch,
- wherein the mast has a strut guide for guiding the strut parallel to the mast during the upwards movement, and
- wherein the mast further comprises a strut positioning component, which is adapted to stop the upwards movement of the strut and force the strut to pivot, until the strut is in the functional position.

The invention further pertains to a method for operating a crane, the method comprising the following steps:

- arranging a crane at a hoisting location, which crane comprises a crane base, a first mast which comprises a plurality of mast sections and is one of the back mast and the main boom, and a second mast which is the other one of the back mast and the main boom, wherein the first mast comprises a first mast tilting member which is arranged between two mast sections, thereby defining a first mast upper part and the first mast lower part of the first mast, assembling the first mast with the first mast tilting member in a straight hoisting state in which the first mast upper part and the first mast lower part are essentially in line with each other, moving the first mast tilting member from the straight hoisting state into a tilted hoisting state wherein the first mast upper part is tilted with respect to the first mast lower part and away from the second mast.

A method according to the invention is a method for operating a crane. Optionally, this is a crane according to the invention; however, a method according to the invention is not limited thereto. Nevertheless, terms and definitions, including components of the crane, used to describe the method have the same meaning as they had earlier in this application with respect to a crane according to the invention, unless specifically stated otherwise.

The method comprises a step of arranging a crane at a hoisting location. The hoisting location may for example be on an industrial site, such as a petrochemical plant. The crane that is arranged and to be operated with a method according to the invention comprises a crane base, a first mast and a second mast. The first mast is one of the main boom and the back mast, and the second mast is the other one. Thus, the crane comprises a main boom and a back mast. The first mast comprises a plurality of mast sections. Between two mast sections, a first mast tilting member is arranged. As such, the first mast is divided in a first mast upper part and a first mast lower part. Optionally, at least one of the first mast and the second mast is a lattice mast.

A method according to the invention comprises a step of assembling the first mast when the first mast tilting member is in a straight hoisting state. In the straight hoisting state, the first mast upper part and the first mast lower part are essentially in line with each other.

A method according to the invention further comprises a step of moving the first mast tilting member from the straight hoisting state into a tilted hoisting state. In the tilted hoisting state, the first mast upper part is tilted with respect to the first mast lower part.

Thus, the invention provides a method for tilting a first mast of a crane, such that hoisting is possible when the first mast is straight as well as when the first mast is tilted. The method provides a solution to expand the horizontal reaching span of the first mast. As such, the method enables to increase the flexibility of the crane.

It is also possible to assembly the crane while the first mast tilting member is in the tilting hoisting position. Therefore, the invention also pertains to a method for operating a crane, the method comprising the following steps:

arranging a crane at a hoisting location, which crane comprises a crane base, a first mast which comprises a plurality of mast sections and is one of the back mast and the main boom, and a second mast which is the other one of the back mast and the main boom, wherein the first mast comprises a first mast tilting member which is arranged between two mast sections, thereby defining a first mast upper part and the first mast lower part of the first mast, assembling the first mast with the first mast tilting member in a tilted hoisting state wherein the first mast upper part is tilted with respect to the first mast lower part and away from the second mast, moving the first mast tilting member from the tilted hoisting state into a straight hoisting state in which the first mast upper part and the first mast lower part are essentially in line with each other.

In a possible embodiment of a method according to the invention, the method further the steps of, prior to moving the first mast tilting part into the tilted hoisting state, attaching a first load to a hoisting wire connected to a hoisting mechanism arranged at an upper end of the main boom, and hoisting a load with the main boom while the first mast tilting member is in the straight hoisting state. The method further comprises the steps of, after moving the first mast tilting member into the tilted hoisting state, attaching a second load to the hoisting wire connected to the hoisting mechanism arranged at the upper end of the main boom, and hoisting the load with the main boom while the first mast tilting member is in the tilted hoisting state.

In this embodiment, loads are hoisted with the crane when the first mast tilting member is in the straight hoisting state as well as when in tilted hoisting state.

In a possible embodiment of a method according to the invention, the method comprises the step of, prior to moving the first mast tilting member into the tilted hoisting state, attaching a third load to a hoisting wire connected to a hoisting mechanism arranged at an upper end of the main boom, and lifting a load, e.g. the third load, with the main boom while the first mast tilting member is in the straight hoisting state. The method then comprises the step of, while the third load is being lifted, moving the first mast tilting member from the straight hoisting state into the tilted hoisting state, and the steps of, when the first mast tilting member is in the tilted hoisting state bringing the third load to a ground surface and detaching the third load from the hoisting wire.

In a possible embodiment of a method according to the invention, the method comprises the step of, when the first mast tilting member into the tilted hoisting state, attaching a fourth load to a hoisting wire connected to a hoisting mechanism arranged at an upper end of the main boom, and lifting a load, e.g. the fourth load, with the main boom while the first mast tilting member is in the tilted hoisting state. The method then comprises the step of, while the fourth load is being lifted, moving the first mast tilting member from the tilted hoisting state into the straight hoisting state, and the steps of, when the first mast tilting member is in the straight hoisting state bringing the fourth load to a ground surface and detaching the fourth load from the hoisting wire.

In these embodiments, the first mast tilting member is brought from the tilted hoisting state into straight hoisting state or vice versa while a load is being lifted, thus when the load is in the air. As such, the embodiment the flexibility of the crane is considerably increased, since the locations where any load can be hoisted from and to increase considerably. This is especially advantageous when there is relatively little free space to maneuver at the hoisting site, for example because of surrounding buildings or other structures.

In a possible embodiment of a method according to the invention, the method comprises the steps of prior to moving the first mast tilting member into the tilted hoisting state:

pulling a strut upwards parallel to the first mast lower part along a strut guide comprised by the first mast lower part, by winding a guywire which is attached to the strut, on a winch, until the strut reaches a strut positioning element, wherein the guywire optionally is a first strut guywire which is attached to a second end of the strut and connected to an upper end of the first mast upper part, pivoting the strut around the strut positioning element until the strut is in a functional position, optionally by winding the guywire further on the winch winding the first strut guywire on a winch until the first strut guywire is tensioned for keeping the first mast upper part in a fixed position relative to the first mast lower part when the first mast tilting member is in the tilted hoisting state.

In this embodiment, the crane further comprises a strut, to which a guywire is attached. For example, the strut has a second end to which a first strut guywire is attached. According to the method, the strut is pulled upwards parallel to the first mast lower part. The upwards movement is accomplished by winding the guywire on a winch. During the upwards movement, the strut is guided by a strut guide, which is comprised by the first mast lower part. The strut is pulled upwards until it reaches a strut positioning element, which stops the upwards movement.

The method then comprises a step of pivoting the strut about a pivot located in the strut positioning element. This may for example be accomplished by further winding the guywire on the winch. The strut positioning element is such that a further upwards movement is prevented, but a pivoting movement is possible. The strut is pivoted until it reaches a functional position.

The method then comprises a step or winding the first strut guywire on the winch, until the first strut guywire is tensioned. When the first strut guywire is tensioned, it can be used to keep the first mast upper part in a fixed position relative to the first mast lower part when the first mast tilting member is in the tilted hoisting state.

It will be appreciated by the skilled person that the method for bringing the strut into the functioning position can also be applied without the other steps of a method according to the invention.

In a possible embodiment of a method according to the invention, the method further comprises the step of assembling the first mast and/or a second mast in an essentially vertical direction. This may for example be with one of the methods disclosed in WO 2016/133389 A2 or the not yet published Dutch patent application NL 2018785, both of which are herein incorporated by reference in its entirely.

In a possible embodiment of a method according to the invention, the method further comprises the step of connecting an upper end of the second mast with an upper end of the first mast by means of a guywire.

In a possible embodiment of a method according to the invention, the step of arranging the crane at the hoisting position includes arranging the second mast, which comprises a plurality of mast sections, and a second mast tilting member which is arranged between two mast sections, thereby defining a second mast upper part and the second mast lower part of the second mast.

In this embodiment, the method further comprises the following steps:

assembling the second mast with the second mast tilting member is in a straight hoisting state in which the second mast upper part and the second mast lower part are essentially in line with each other, moving the second mast tilting member from the straight hoisting state into a tilted hoisting state wherein the second mast upper part is tilted with respect to the second mast lower part and away from the first mast.

Thus, in this embodiment of the method, both the main boom and the back mast are tilted. The first mast comprises a first mast tilting member for this, and the second mast a second mast tilting member.

As explained above, the method for bringing the strut into the functioning position can also be applied without the other steps of a method according to the invention. Therefore, the invention further pertains to a method for bringing a strut into a functional position. This method may be applied in combination or without a method according to the invention for operating a crane. The crane comprises at least a mast. The method comprises the steps of pulling a mast strut upwards parallel to the mast along a mast strut guide comprised by the mast, by winding a mast strut guywire which is attached to the mast strut, for example on a second end of the mast strut, on a mast strut guywire winch, until the mast strut reaches a mast strut positioning component, pivoting the mast strut around the mast strut positioning system by further winding the mast strut guywire on the mast strut guywire winch until the mast strut is in a functional position, further winding the mast strut guywire on the mast strut guywire winch until the mast strut guywire is tensioned.

Although the invention is described with respect to a crane comprising a main boom and a back mast, it is noted that it is also envisaged that the invention can be applied to crane without a back mast. Thus in this case, the main boom comprises the first mast tilting member. Therefore, the invention also pertains to a crane, which crane comprises:

a crane base, a first mast, which is pivotable about a first pivot which is arranged at the crane base and has a horizontal pivot axis, which first mast comprises a plurality of mast sections, wherein the first mast is the main boom, wherein the first mast comprises a first mast tilting member which is arranged between two mast sections, thereby defining a first mast upper part and the first mast lower part of the first mast, wherein the first mast upper part comprises at least one mast section and is arranged between the first mast tilting member and an upper end of the first mast, the first mast lower part comprises at least one mast section and is arranged between the crane base and the first mast tilting member, and the first mast tilting member comprises an upper connection part connected to the first mast upper part and a lower connection part connected to the first mast lower part, has a straight hoisting state wherein the first mast upper part and the first mast lower part are essentially in line with each other, and a tilted hoisting state wherein the first mast upper part is tilted with respect to the first mast lower part, is adapted to transfer forces from the first mast upper part to the first mast lower part in both the straight hoisting state and the tilted hoisting state.

A method according to the invention can also be applied to a crane without a back mast. The invention therefore also relates to a method, the method comprising the following steps:

arranging a crane at a hoisting location, which crane comprises a crane base, a first mast which comprises a plurality of mast sections, wherein the first mast comprises a first mast tilting member which is arranged between two mast sections, thereby defining a first mast upper part and the first mast lower part of the first mast, assembling the first mast with the first mast tilting member is in a straight hoisting state in which the first mast upper part and the first mast lower part are essentially in line with each other, moving the first mast tilting member from the straight hoisting state into a tilted hoisting state wherein the first mast upper part is tilted with respect to the first mast lower part.

BRIEF DESCRIPTION OF THE DRAWINGS

The invention will be described in more detail below in reference to the figures, in which in a non-limiting manner exemplary embodiments of the invention will be shown. Across the various figures, the same reference numbers have been used to indicate the same features.

In the figures.

DETAILED DESCRIPTION OF THE DISCLOSURE

Figure 1:
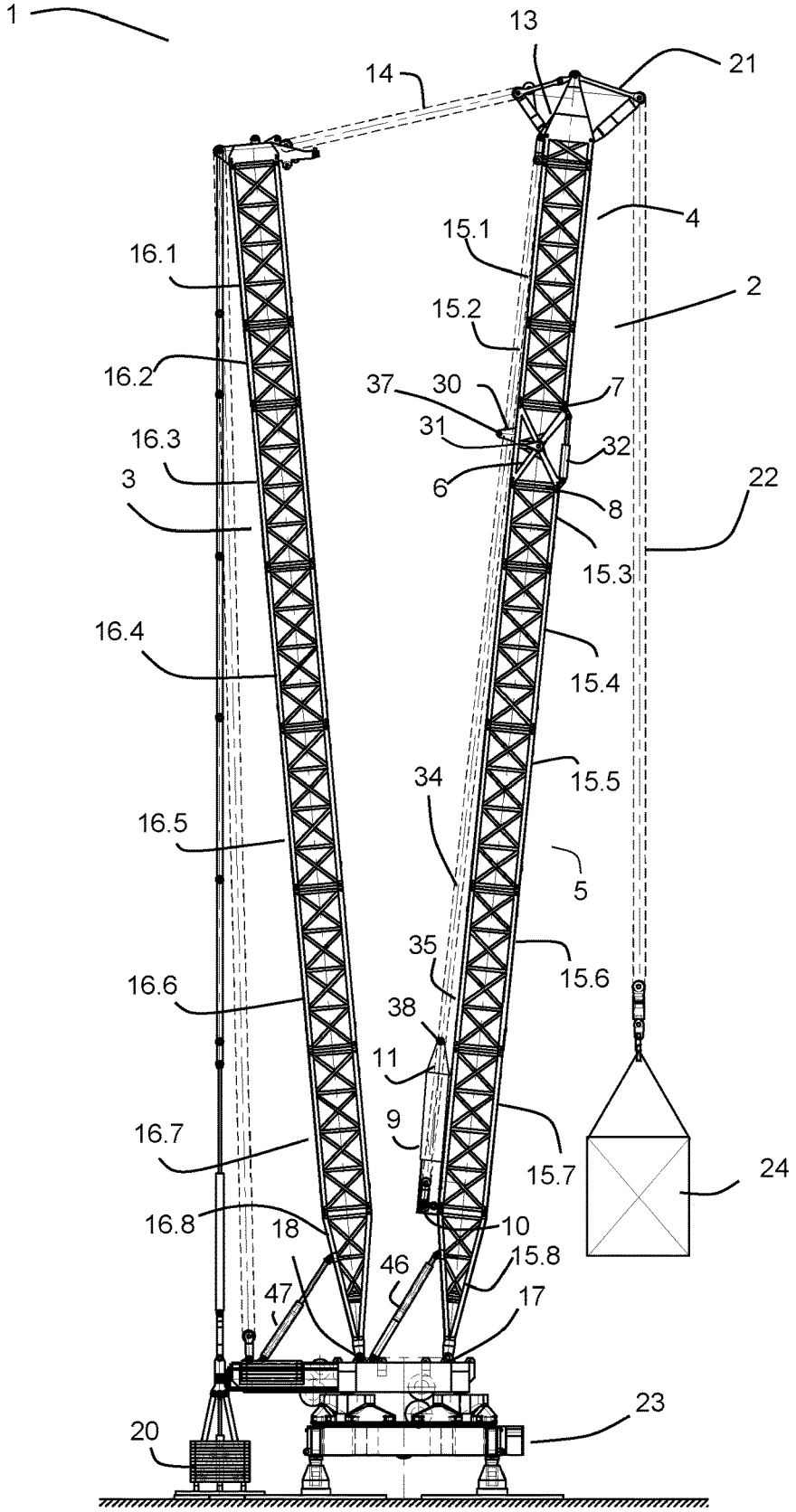
FIG. 1 shows a possible embodiment of a crane according to the invention, wherein the first mast tilting member is in the straight hoisting state.

FIG. 1 shows a possible embodiment of a crane 1 according to the invention. The crane 1 has a first mast 2 and a second mast 3, both supported by a crane base 23. In the example of FIG. 1, the first mast 2 is the main boom and the second mast 3 is the back mast, and both are lattice masts. The first mast 2 is a lattice mast and comprises multiple mast sections 15.1-15.8. The first mast 2 has a first pivot 17, and the second mast 3 has a second pivot 18, both located at the crane base 23. Both pivots 17,18 have a horizontal pivot axis (not shown). In the shown example, the second mast 3 also is a lattice mast comprising multiple mast section 16.1-16.8.

The first mast 2 comprises a first mast tilting member 6, which is arranged between mast sections 15.2 and 15.3. The first mast tilting member 6 divides the first mast 2 in a first mast upper part 4 and a first mast lower part 5. The first mast upper part 4 comprises two mast sections 15.1, 15.2, and extends from the first mast tilting member 6 to an upper end 13 of the first mast 2. The first mast lower part 5 is located between the crane base 23 and the first mast tilting member 6. The first mast lower part 5 comprises six mast sections 15.3-15.8. Mast sections 15.1-15.7 have similar cross sectional dimensions. Moreover, mast section 15.2 is identical to mast section 15.3, and mast section 15.1 is identical to mast sections 15.3-15.7. Only mast section 15.8 has different cross sectional dimensions, since this mast section 15.8 is adapted to be connected to the crane base 23.

The first mast tilting member 6 is connected to the first mast upper part 4 by an upper connection part 7 and to the first mast lower part 5 by a lower connection part 8. The first mast tilting member 6 further comprises an extendable cylinder 32. In the situation shown in FIG. 1, the extendable cylinder 32 is in its extended position.

In FIG. 1, the first mast tilting member 6 is in a straight hoisting state. In the straight hoisting state, the first mast upper part 4 and the first mast lower part 5 are essentially in line with each other. As can be seen in FIG. 1, in the straight hoisting state, the first mast 2 of the crane 1 according to the invention looks similar to a conventional crane with a conventional first mast, and it also functions similar. That is, in the straight hoisting state the crane 1 can hoist a load 24 with hoisting mechanism 21 comprising a hoisting wire 22. The hoisting wire 22 is connected to the first mast 2 at the upper end 13 of the first mast 2. The hoisting wire 22 is a main hoisting wire, meaning that it is adapted to hoist the maximum load the crane 2 is designed for. The crane 2 does not comprise an auxiliary hoisting wire.

In the shown example, the first mast 2 is connected to the second mast 3 by a second mast guywire 14, which is also connected to a ballast weight 20. The forces that are present in the first mast upper part 4, are transferred to the first mast lower part 5 via the first mast tilting member 6. It should be noted that, depending on the location of the load, before hoisting in the straight hoisting state, both the first mast 2 and the second mast 3 may be pivoted about their respective pivots 17, 18, such that the first and second mast 2,3 are less vertical. Also the ballast weight 20 may be brought to a position further away from the crane base 23. Thus, the situation shown in FIG. 1 is not the most horizontal position in which the first mast 2 and second mast 3 can be arranged for hoisting.

The crane 1 further comprises a first mast stop 46 and second mast stop 47 for the first mast 2 and the second mast 3 respectively. The first and second stop 46,47 are adapted to prevent the first and second mast 2,3 from falling backwards. Optionally, it is envisaged that when the back mast 3 it tilted further with respect to the horizontal, that is additional back mast stop (not shown) can be provided above the ballast 20 to prevent the back mast from falling down, since in such a situation the forces on the second mast stop 47 may be too large.

According to the invention, the first mast tilting member 6 of the crane 1 also has a tilted hoisting state, wherein the first mast upper part 4 is tilted with respect to the first mast lower part 5. This will be explained in more detail with reference to FIGS. 4*a*-4*b*. The crane 1 comprises a strut 9 for keeping the first mast upper part 4 in a fixed position relative to the first mast lower part 5, when the first mast tilting member 6 is in said tilted hoisting state.

In the situation shown in FIG. 1, the strut 9 is in a non-functional position. In the shown example said non-functional position entails that the strut 9 is parallel to the first mast lower part 5. The strut 9 has a second end 10 that is connected to a first strut guywire 34. As can be seen, the first strut guywire 34 is attached to the strut 9 on a location that does not fall on the centerline of the strut. The first strut guywire 34 is connected to a sheaf (not shown) at the upper end 13 of the first mast upper part 4. The first strut guywire 34 is further connected to a winch (not shown). The winch in the shown example is located in the upper part 4.

By winding the first strut guywire 34 on the winch, an upwards pulling force is created on the strut 9, which causes the strut 9 to move upwards parallel to the first mast lower part 5. During this upwards movement, the strut 9 is guided by the first mast lower part 5, which has a strut guide 35. In the shown example, the outside of the first mast lower part 5 functions as the strut guide 35. The upwards movement is stopped when a first end 11 of the strut 9 reaches a strut positioning element 30. The strut positioning element 30 has a strut positioning hole 37. The strut 9 has at its first end 11 also a strut positioning hole 38. The strut positioning holes 37, 38 are aligned when the strut 9 reaches the strut positioning element 30, which is the situation shown in FIG. 2.

Figure 2:
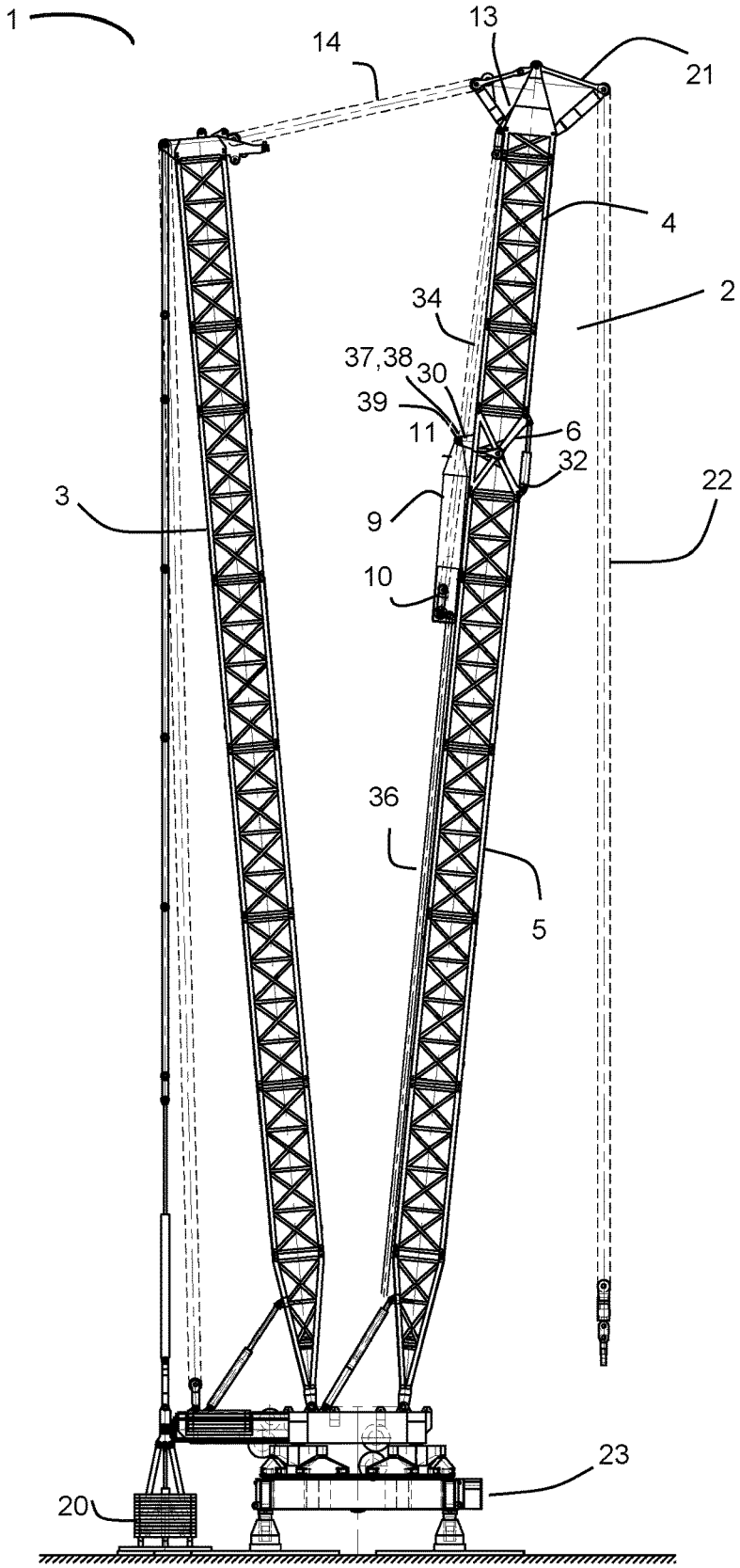
FIG. 2 illustrates a possible embodiment of a crane according to the invention, wherein the strut is pulled up until the strut positioning element.
Figure 3:
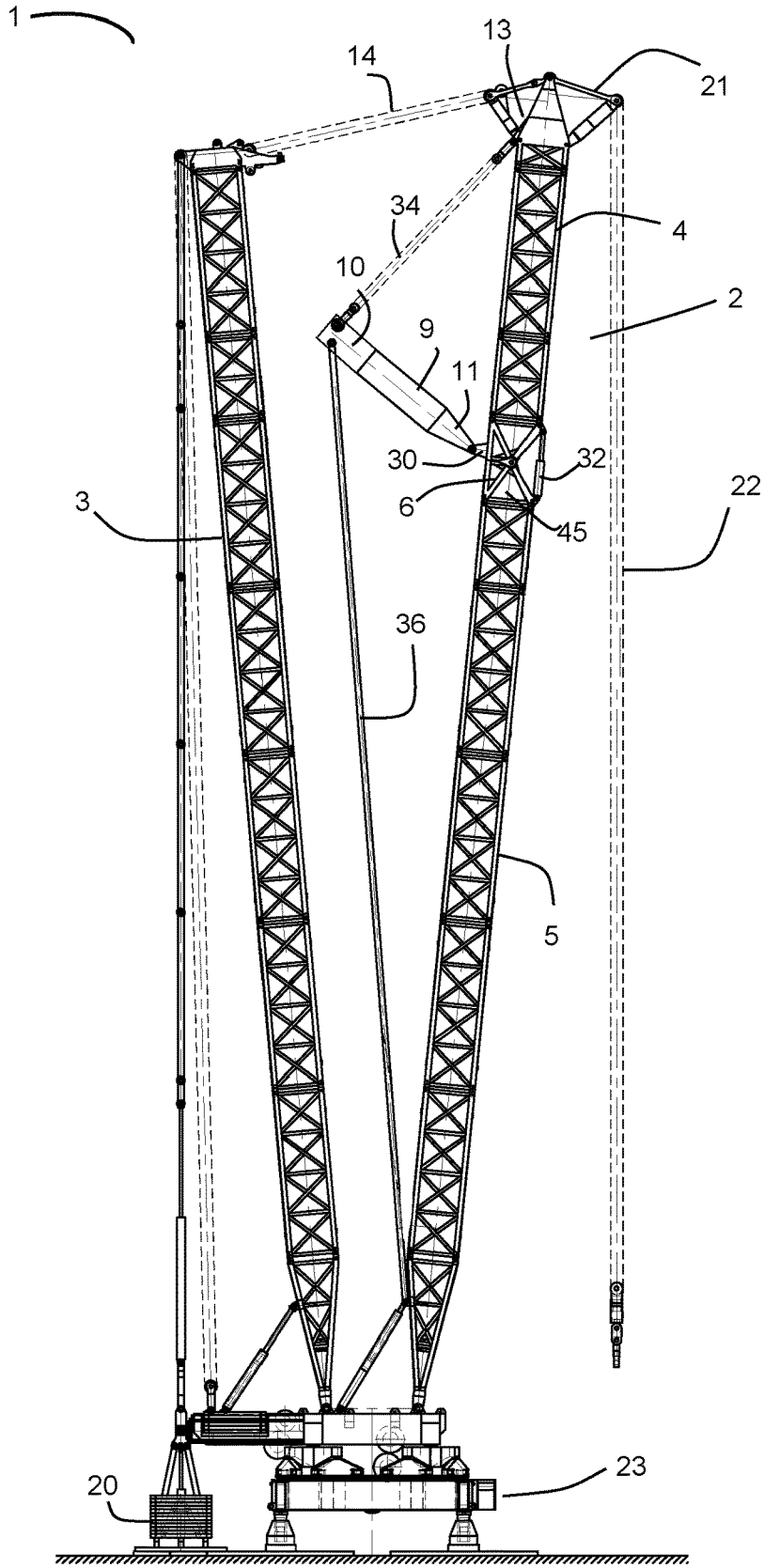
FIG. 3 illustrates a possible embodiment of a crane according to the invention, wherein the strut is pivoted into the functioning position.

In FIG. 2, the second end 11 of the strut 9 is in contact with the strut positioning element 30, which prevents the strut 9 to move further upwards parallel to the first mast lower part 5. A strut positioning pin is arranged through the aligned strut positioning holes 37,38. However, a rotational movement is not prevented. The second end 10 is attached to the first strut guywire 34. The second end 10 is also attached to a second strut guywire 36, which in turn is also attached to the bottom of the first mast lower part 5. The second strut guywire 36 is attached in a different attachment point than the first strut guywire 34. By maintaining the pulling force in the first strut guywire 34 on the first end 10 of the strut 9, the strut 9 is pivoted around the strut positioning element 30, until the strut 9 reaches a functional position, which is shown in FIG. 3. The pivoting of the strut 9 can be accomplished because the first strut guywire 36 is attached to the strut 9 on a location that is not on the centerline of the strut 9.

In FIG. 3, the strut 9 is in the functional position. In the functional position, the first end 11 of the strut 9 is connected to the first mast 2, via the strut positioning element 30. The second strut guywire 36 is limited in length, which length is predetermined. Once the second strut guywire 36 is at its full length and tensioned, it prevents the strut 9 from moving further upwards or pivoting further. As such, the strut 9 is kept in the functional position. Once the strut 9 is in the functional position, the first mast tilting member 6 can be adapted into the tilted hoisting state.

Figure 4A:
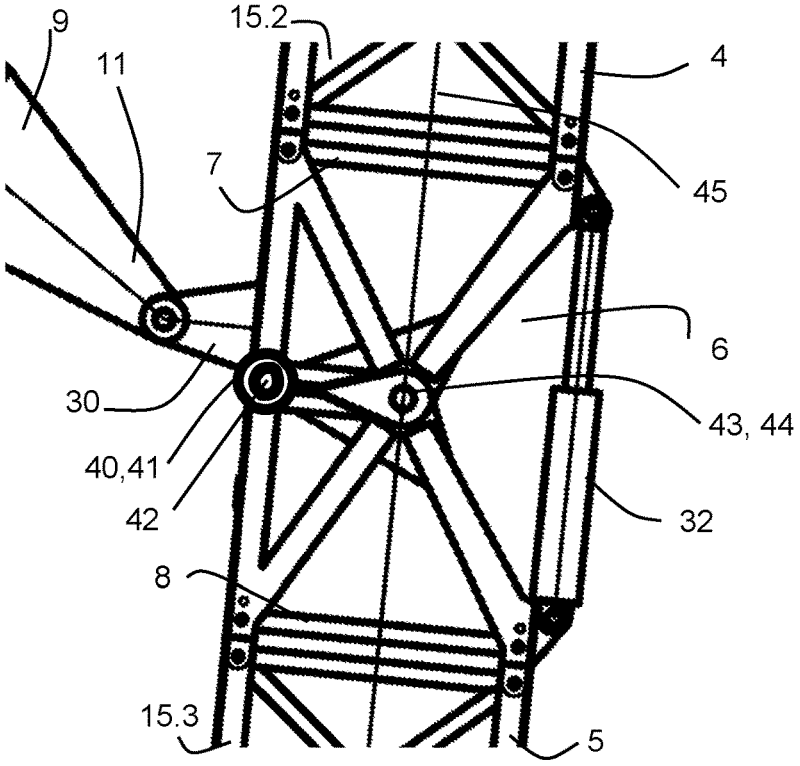
FIG. 4*a* shows the first mast tilting member in the straight hoisting state.
Figure 4B:
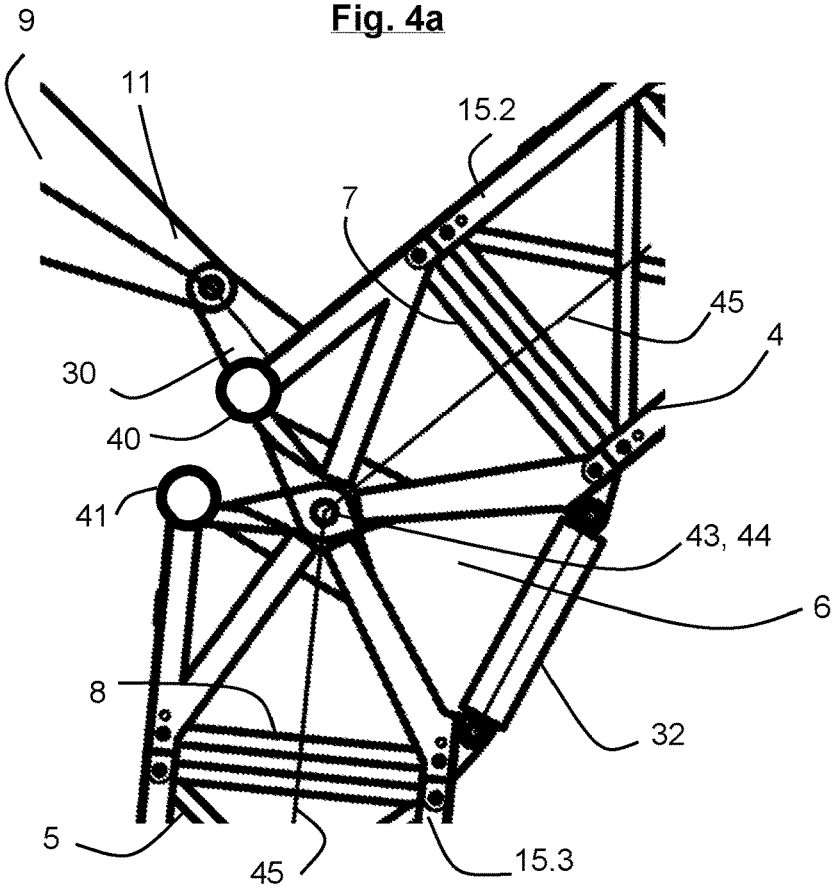
FIG. 4*b* shows the first mast tilting member in the tilted hoisting state.

FIG. 4*a* shows a close-up of the first mast tilting member 6 in the straight hoisting state, and FIG. 4*b* in the tilted hoisting state. Also visible in these figures is the strut positioning element 30 which in this example is attached to the first mast tilting member 6, and the first end 11 of the strut 9 which has already been brought into the functional position.

The first mast tilting member 6 comprises a first upper part locking device, comprising two positioning holes 40, 41 and a pin 42. In the straight hoisting state shown in FIG. 4*a*, the two positioning holes 40, 41, are aligned. In this position, the pin 42 is inserted into the positioning holes 40, 41. The pin 42 is connected to a hydraulic cylinder (not shown), which is controllable by an operator on the ground level. As such, the operator can insert or remove the pin 42 from the positioning holes 40,41. By this pin-hole connection, the first mast tilting member 6 is prevented from moving into the tilted hoisting state. Thus, the first mast upper part 4 is locked in a fixed position relative to the first mast lower part 5.

The first mast titling section further comprises a hinge 43. The hinge 43 is located in the center of the cross section of the first mast tilting member 6, seen in a direction which in FIG. 4*a* goes from left to right. On the location of the hinge 43, the first mast tilting member 6 has a first tilting axis 44 which in FIGS. 4*a*-4*b* extends in a direction perpendicular to the paper. Thus, the first tilting axis 44 is also located in the center of the cross section. Since the mast sections of the first mast 2 are symmetrically, the neutral plane 45 of the first mast 2 is located on the central axis of the first mast 2. Hence, the first tilting axis 44 extends perpendicular to the neutral plane 45, and they have an intersection point. This enhances a symmetrical division of the forces that come from the first mast upper part 4, onto the first mast lower part 5.

In the straight hoisting state shown in FIG. 4*a*, the extendable cylinder 32 is in the extended state. The extendable cylinder 32 is also a hydraulic cylinder, and also controllable by an operator on the ground level. In the straight hoisting state, the extendable cylinder 32 also prevents the first mast upper part 4 from tilting relative to the first mast lower part 5. To move the first mast tilting member 6 from the straight hoisting state to the tilted hoisting state, an operator first removes the pin 42 by operating the hydraulic cylinder attached to the pin 42. Thereafter, the operator controls the extendable cylinder 32 to retract it. The retracting movement of the extendable cylinder 32 results in a small pulling force on the first mast upper part 4, on the right side as shown in FIGS. 4*a*-4*b*, which causes the first mast upper part 4 to start tilting. Once the tilting has started, it is continued under the influence of gravity, until the first mast tilting member 6 is in the tilted hoisting state as shown in FIG. 4*b*. In the tilted hoisting state, the extendable cylinder 32 is without any internal pressure. Furthermore, essentially no forces are transferred from the first mast upper part 4 to the first mast lower part 5 though the extendable cylinder 32. Thus, essentially all those forces are transferred through the hinge 43 which is located on the neutral plane 45.

During the tilting, i.e. the movement from the straight hoisting state to the tilted hoisting state, the length of the first strut guywire 34 (see FIG. 3) is controlled such that the tilting can be controlled. By slowly letting the length of the first strut guywire 34 increase, the first mast upper part 4 slowly tilts more with respect to the first mast lower part 5.

Figure 5:
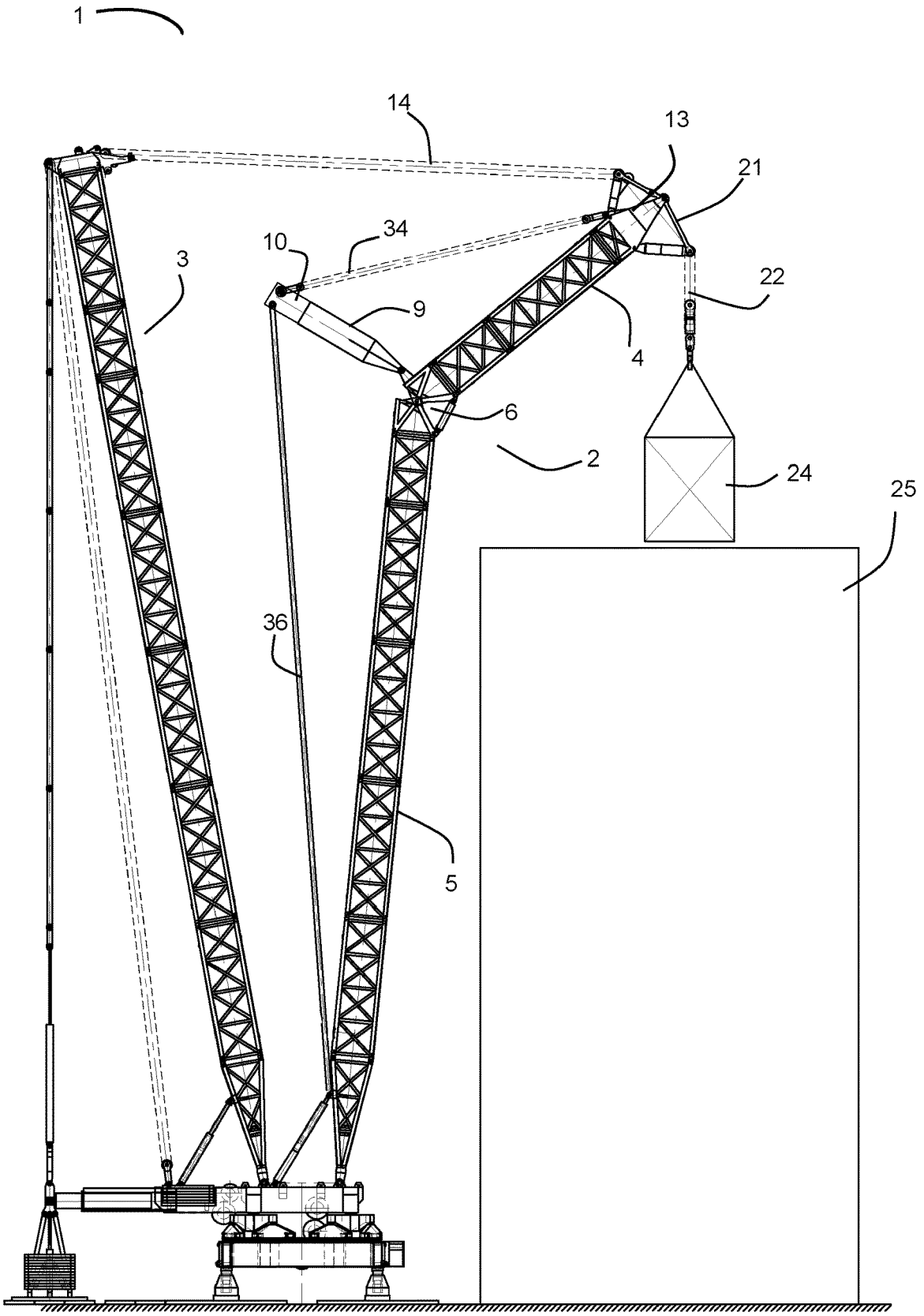
FIG. 5 shows a possible embodiment of a crane according to the invention, wherein the first mast tilting member is in the tilted hoisting state.

FIG. 5 shows the crane 1 while hoisting a load 24, when the first mast tilting member 6 is in the tilted hoisting state. In the example shown in FIG. 5, a building 25 is in the close vicinity of the crane 1, and the crane 1 is used to hoist the load 24 onto the building 25. The building 25 being so close to the crane 1, prevents the first mast 2 from being in a relatively horizontal position. In the straight hoisting state, the first mast 2 would not be able to hoist the load 24 onto the building 25, because the first mast 2 would clash with the building 25. The crane 1 according to the invention comprising the first mast tilting member 6, made it possible to bring the first mast upper part 4 in a tilted position relative to the first mast lower part 5. As such, the horizontal reaching span of the first mast 2 is increased, as well as the flexibility and maneuverability of the crane 1.

During the hoisting with the first mast tilting member 6 in the tilted hoisting state, the strut 9 is in the functional position, and the first strut guywire 34 locks the first mast upper part 4 in a fixed position relative to the first mast lower part 5. As explained above, the first strut guywire 34 is winded on a winch (not shown) for bringing the strut 9 in the functional position. Once the strut 9 is in the functional position, the second strut guywire 36 prevents the strut 9 from moving or pivoting further upwards. Thus, the end of the first strut guywire 34 at the strut 9 is essentially in a fixed position. By controlling the length of the first strut guywire 34, which can be accomplished by winding more or less on the winch, the distance between the upper end 13 of the first mast upper part 4 and the second end 10 of the first mast strut 9 is also controlled. By maintaining this distance constant, the first mast upper part 4 is locked in a fixed position relative to the first mast lower part 5.

To bring the first mast tilting member 6 back into the straight hoisting state, the first strut guywire 34 can be winded further on the winch. By doing this, the distance between the strut 9 and the upper end 13 of the first mast upper part 4 is decreased. Since the strut 9 is prevented from moving further upwards by the second strut guywire 36, the upper end 13 is forced to move closer to the strut 9. Eventually, the first mast upper part 4 will be in line with the first mast lower part 5. The operator can then lock the first mast tilting member in the straight hoisting state with the pin 42, which was shown in FIG. 4*a*.

In FIG. 5, the second mast guywire 14 connects the second mast 3 to the first mast 2 in the upper end 13 of the first mast upper part 4. The second mast guywire 14 absorbs forces directly from the upper end 13 to the second mast 3, meaning that the first mast upper part 4 is not subjected to those forces. This reduces all the forces in the first mast 2 considerably, and as such also the moments and stresses.

Figure 6:
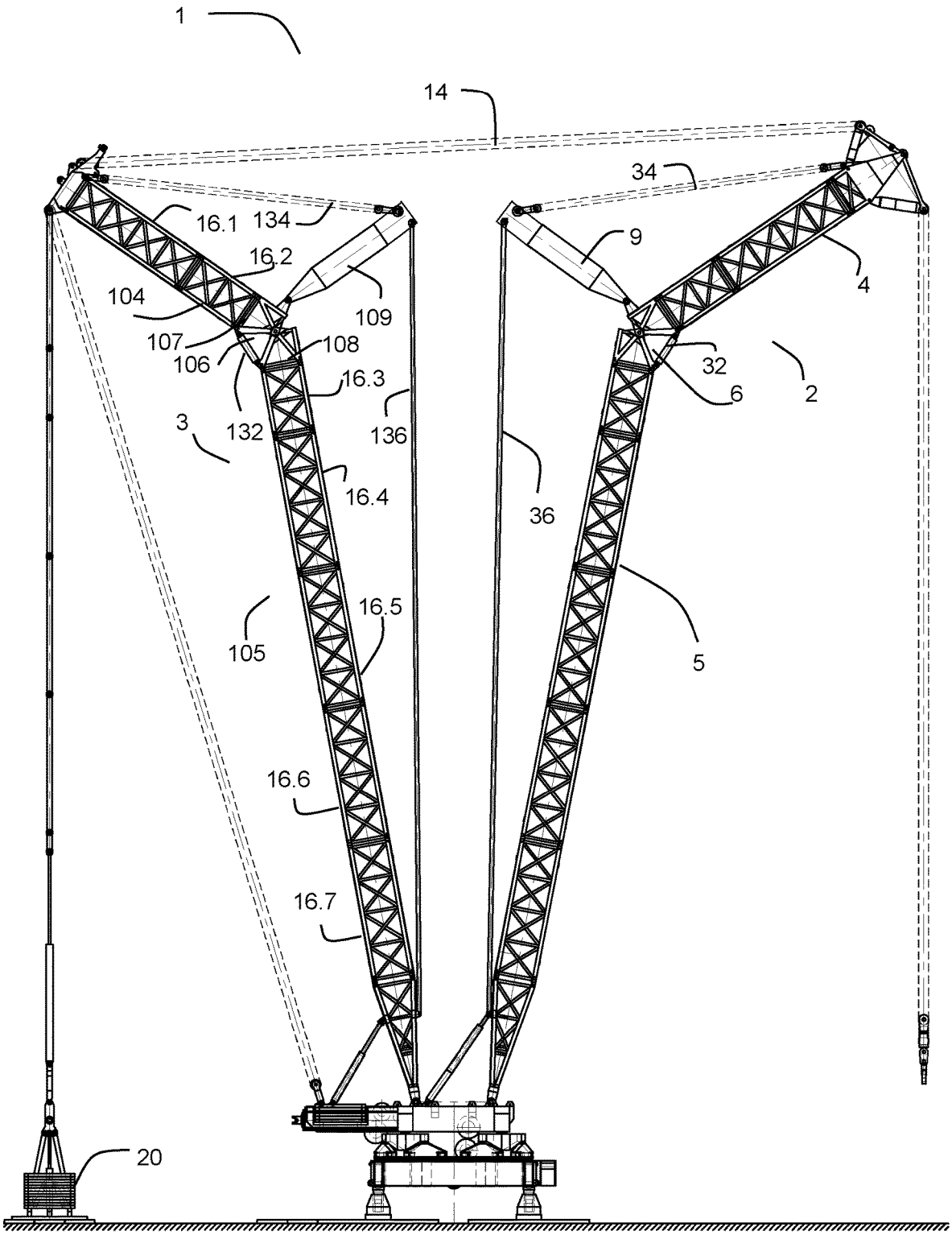
FIG. 6 shows a possible embodiment of the invention, wherein both the main boom and the back mast comprise a respective tilting part.

FIG. 6 shows an embodiment a crane 1 according to the invention, wherein also the second mast 3 can be tilted. In the shown example, this is accomplished in a very similar way as for the first mast 2. However, it is also possible that there are differences between the two tiltable masts 2, 3, since the invention is not limited to the example shown in these figures.

The second mast 3 in FIG. 6 comprises multiple mast section 16.1-16.7. A second mast tilting member 106 is arranged between mast sections 16.2 and 16.3. The second mast tilting member 106 is very similar to the first mast tilting member 6, and also comprises an extendable cylinder 132. The second mast tilting member 106 has a straight hoisting states and a tilted hoisting state. The second mast 3 is divided by the second mast tilting member 106 into a second mast upper part 104 comprising two mast sections 16.1, 16.2, and a second mast lower part 105 comprising six mast section 16.3-16.8. Mast section 16.2 is identical to mast section 16.3, and mast section 16.1 is identical to mast sections 16.4-16.7. The second mast titling part 106 further also comprises an upper connection part 107 connected to the second mast upper part 104 and a lower connection part 108 connected to the second mast lower part 105, as well as two positioning holes (not shown) and a pin (not shown) for locking the second mast upper part 104 in a fixed position relative to the second mast lower part 105, when the second mast tilting member 106 is in the straight hoisting state.

The second mast 3 further comprises a second mast strut 109, which can be brought into a functional position in the same way as the strut 9. A first strut guywire 134 and a second strut guywire 136 are provided, with the same function as their counterparts at the first mast 2. By tilting the back mast, the outreach of the ballast weight 20 is increased.

As can be seen, the tilting of the second mast 3 in the shown example is very similar as the first mast 2. All embodiments that are possible for the first mast 2, are also possible for the second mast 3. Furthermore, it is also possible that only the back mast can be tilted, and not the main boom.

Figure 7A:
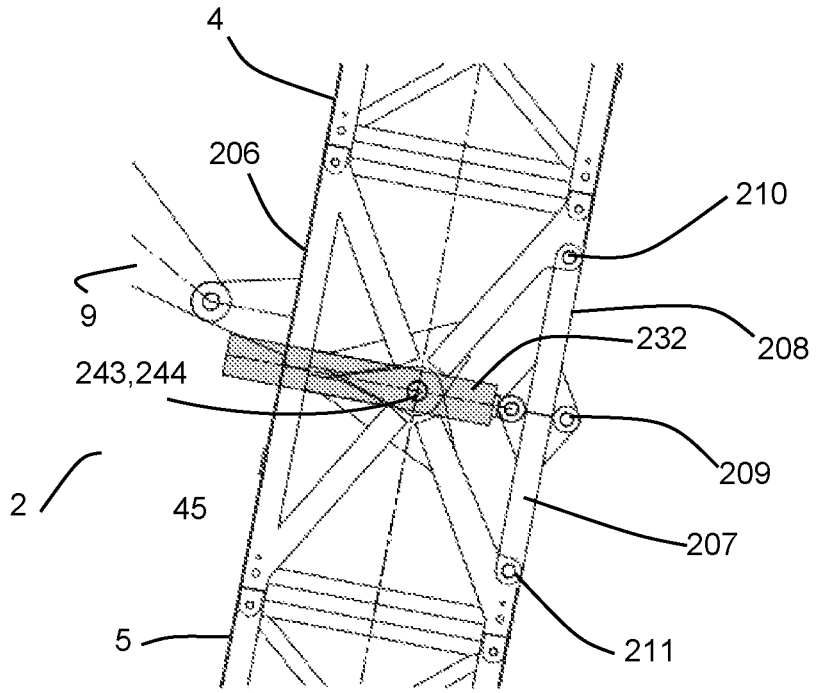
FIG. 7*a* illustrates another possible embodiment of the first mast tilting member in the straight hoisting state.
Figure 7B:
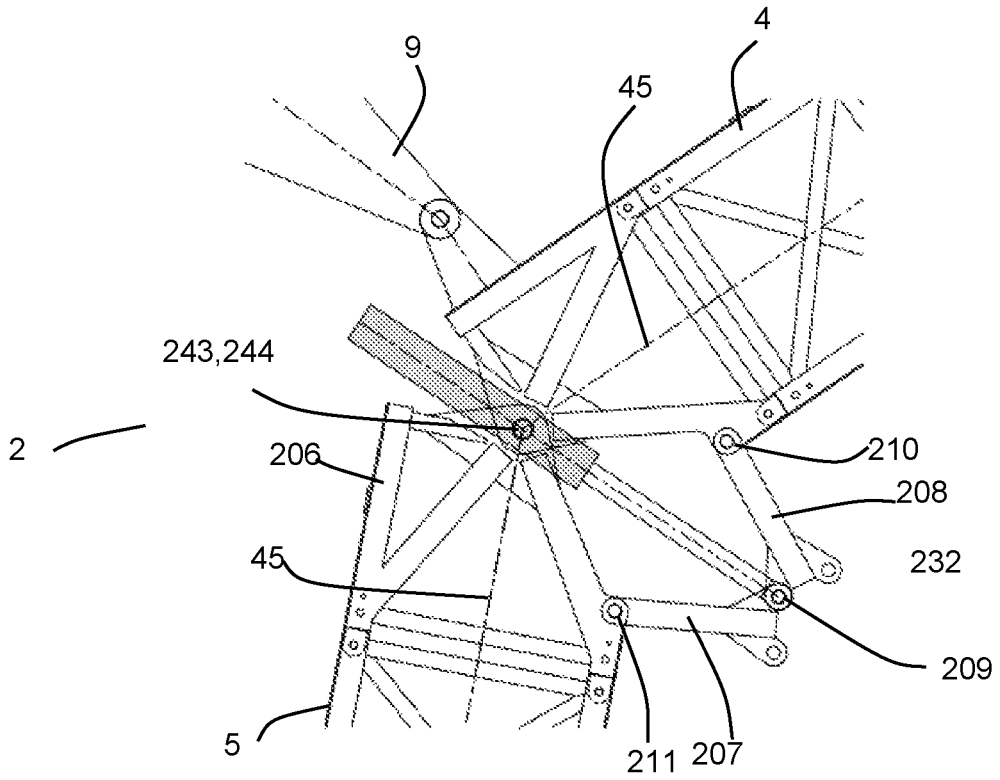
FIG. 7*b* illustrates another possible embodiment of the first mast tilting member in the tilted hoisting state.

FIG. 7*a* and FIG. 7*b* show another possible embodiment of the first mast tilting member 206, in the straight hoisting state and the tilted hoisting state respectively. This first mast tilting member 206 also comprises an extendable cylinder 232. However, the extendable cylinder 232 in this case is not arranged directly between the first mast upper part 4 and the first mast lower part 5. Instead, it is arranged essentially perpendicular to the neutral axis 45 of the first mast 2 and connected to a hinge 209. To said hinge 209, there is also connected a first bar 208 which is connected to the first mast upper part 4 by hinge 210, and a second bar 207 which is connected to the first mast lower part 5 by hinge 211.

In the straight hoisting state as shown in FIG. 7*a*, the extendable cylinder 232 is in a retracted state. By extending the extendable cylinder 232, the hinge 209 is pushed to a direction away from the first mast 2, which in FIGS. 7*a*-7*b* is to the right. The first and second bar 207,208 will thus also be pushed in that direction, and pivot about the hinges 210 and 211 respectively. As such, the tilting of the first mast upper part 4 relative to the first mast lower part 5 is initialized. Again, once initialized, the first mast upper part 4 will tilt further under the influence of gravity.

In the tilted hoisting state as shown in FIG. 7*b*, the extendable cylinder 232 is in an extended state. The first mast tilting member 232 also comprises a hinge 243 which is located on a first mast titling axis 244, which again is in the neutral plane 45 of the first mast. In the tilted hoisting state, all forces are transferred from the first mast upper part 4 to the first mast lower part 5 through the hinge 243. Thus, the extendable cylinder 232 and the first and second bar 207,208, are subjected to essentially no forces.

The invention claimed is:

1. A Crane, which crane comprises:

a crane base;

a first mast, which first mast comprises a plurality of first mast sections, wherein the first mast is one of the main boom and the back mast of the crane; and a second mast, wherein the second mast is the other of the main boom and the back mast, wherein the main boom is pivotable about a first pivot which is arranged at the crane base and has a horizontal pivot axis, wherein the first mast comprises a first mast tilting member which is arranged between two of the first mast sections, thereby defining a first mast upper part and a first mast lower part of the first mast, wherein the first mast upper part comprises at least one of the first mast sections and is arranged between the first mast tilting member and an upper end of the first mast, wherein the first mast lower part comprises at least one of the first mast sections and is arranged between the crane base and the first mast tilting member, and wherein the first mast tilting member:

(i) comprises an upper connection part connected to the first mast upper part and a lower connection part connected to the first mast lower part, (ii) has a straight hoisting state in which the first mast upper part and the first mast lower part are essentially in line with each other, and a tilted hoisting state in which the first mast upper part is tilted with respect to the first mast lower part and away from the second mast, and (iii) is adapted to transfer forces from the first mast upper part to the first mast lower part in both the straight hoisting state and the tilted hoisting state.

2. The Crane of claim 1, wherein the first mast is the back mast; and wherein the second mast, which is pivotable about the first pivot which is arranged at the crane base and has the horizontal pivot axis, is the main boom.

3. The Crane according to claim 1, wherein a first cross section of the at least one first mast section of the first mast upper part that is connected to the first mast tilting member is of the same dimensions as a second cross section of the at least one first mast section of the first mast lower part that is connected to the first mast tilting member.

4. The Crane according to claim 1, wherein multiple of the plurality of first mast sections of the first mast, and the upper connection part and the lower connection part of the first mast tilting member, are adapted such that the first mast tilting member can be arranged between any two of the multiple first mast sections.

5. The Crane according to claim 1, wherein the crane further comprises a strut with a first strut end connected to the first mast and a second strut end attached to a first strut guywire, which first strut guywire is attached to the upper end of the first mast upper part for keeping the first mast upper part in a fixed position relative to the first mast lower part when the first mast tilting member is in the tilted hoisting state.

6. The Crane according to claim 5, wherein the crane further comprises a second strut guywire, which is attached to the second end of the strut, and to the first mast lower part or the crane base, wherein the crane further comprises a winch for winding one of the first strut guywire and the second strut guywire, wherein, when the first mast tilting member is in the tilted hoisting state, (a) a first distance between the second end of the strut and the upper end of the first mast upper part is determined by the first strut guywire, and (b) a second distance between the second end of the strut and the first mast lower part and/or crane base is determined by the second strut guywire, and wherein the first mast upper part is adapted to be moved in line with the first mast lower part to bring the first mast tilting member into the straight hoisting state, by winding one of the first strut guywire and the second strut guywire on the winch.

7. The Crane according to claim 5, wherein the strut has: (a) a functional position for keeping the first mast upper part in a fixed position relative to the first mast lower part when the first mast tilting member is in the tilted hoisting state, and (b) a non-functional position it in which the strut is essentially parallel with the first mast lower part and in which the first end of the strut is located above the second end, wherein the crane comprises a winch for winding a guywire which is attached to the strut, which is adapted to subject the strut to an upwards movement by winding the guywire on the winch, wherein the first mast lower part has a strut guide for guiding the strut parallel to the first mast lower part during the upwards movement, and wherein the first mast further comprises a strut positioning element, which is adapted to stop the upwards movement of the strut and force the strut to pivot, until the strut is in the functional position.

8. The Crane according to claim 7, wherein the second end of the strut is further attached to a second strut guywire, which second strut guywire is also attached to the first mast lower part or to the crane base, wherein the second strut guywire has a length which is adapted to maintain the strut in the functional position.

9. The Crane according to claim 1, wherein the first mast tilting member further comprises an extendable cylinder, which is adapted to move the first mast tilting member from the straight hoisting state to the tilted hoisting state.

10. The Crane according to claim 9, wherein the first mast tilting member is in the straight hoisting state when the extendable cylinder is extended and in the tilted hoisting state when the extendable cylinder is retracted.

11. The Crane according to claim 1, wherein a back length of the back mast is longer than 50% of a main length of the main boom, wherein the back length of the back mast is longer than 75% of the main length of the main boom, or wherein the back length of the back mast is approximately equal to the main length of the main boom.

12. The Crane according to claim 1, wherein the first mast tilting member has a tilting axis over which the first mast upper part is tilted relative to the first mast lower part, wherein the tilting axis is located in proximity of a neutral plane of the first mast tilting member.

13. The Crane according to claim 1, wherein the first mast tilting member comprises a first upper part locking device, which is adapted to lock the first mast upper part in a fixed position relative to the first mast lower part when the first mast tilting member is in the straight hoisting state.

14. The Crane according to claim 13, wherein the first upper part locking device comprises an extendable hydraulic cylinder, wherein the first mast upper part is locked in a fixed position relative to the first mast lower part when the extendable hydraulic cylinder is in the extended state, and wherein the first mast upper part is movable relative to the first mast lower part when the extendable hydraulic cylinder is in the retracted state, or vice versa.

15. The Crane according to claim 1, wherein the second mast also comprises a plurality of second mast sections, wherein the second mast comprises:

a second mast upper part comprising at least one of the second mast sections;

a second mast lower part comprising at least one of the second mast sections; and a second mast tilting member, wherein the second mast tilting member:

(i) is arranged between the second mast upper part and the second mast lower part, and comprises an upper connection part connected to the second mast upper part and a lower connection part connected to the second mast lower part, (ii) has a straight hoisting state in which the second mast upper part and the second mast lower part are essentially in line with each other, and a tilted hoisting state in which the second mast upper part is tilted with respect to the second mast lower part, and (iii) is adapted to transfer forces from the second mast upper part to the second mast lower part in both the straight hoisting state and the tilted hoisting state.

16. The Crane of claim 1, wherein the first mast is the main boom; and wherein the second mast is the back mast.

17. A Method for operating a crane, the method comprising the following steps:

arranging a crane at a hoisting location, which crane comprises a crane base, a first mast which comprises a plurality of first mast sections and is one of the back mast and the main boom, and a second mast which is the other one of the back mast and the main boom, wherein the first mast comprises a first mast tilting member which is arranged between two of the first mast sections, thereby defining a first mast upper part and a first mast lower part of the first mast;

assembling the first mast with the first mast tilting member in a straight hoisting state in which the first mast upper part and the first mast lower part are essentially in line with each other; and moving the first mast tilting member from the straight hoisting state into a tilted hoisting state in which the first mast upper part is tilted with respect to the first mast lower part and away from the second mast.

18. The Method according to claim 17, wherein the method further comprises the following steps:

prior to moving the first mast tilting member into the tilted hoisting state, attaching a first load to a hoisting wire connected to a hoisting mechanism arranged at an upper end of the main boom, and hoisting the first load with the main boom while the first mast tilting member is in the straight hoisting state; and after moving the first mast tilting member into the tilted hoisting state, attaching a second load to the hoisting wire connected to the hoisting mechanism arranged at the upper end of the main boom, and hoisting the second load with the main boom while the first mast tilting member is in the tilted hoisting state.

19. The Method according to claim 17, wherein the method comprises the steps of:

prior to moving the first mast tilting member into the tilted hoisting state, attaching a third load to a hoisting wire connected to a hoisting mechanism arranged at an upper end of the main boom, and lifting the third load with the main boom while the first mast tilting member is in the straight hoisting state;

while the third load is being lifted, moving the first mast tilting member from the straight hoisting state into the tilted hoisting state; and when the first mast tilting member is in the tilted hoisting state, bringing the third load to a ground surface and detaching the third load from the hoisting wire.

20. The Method according to claim 17, further comprising the steps of, when the first mast tilting member into the tilted hoisting state, attaching a fourth load to a hoisting wire connected to a hoisting mechanism arranged at an upper end of the main boom, and lifting the fourth load with the main boom while the first mast tilting member is in the tilted hoisting state;

while the fourth load is being lifted, moving the first mast tilting member from the tilted hoisting state into the straight hoisting state; and when the first mast tilting member is in the straight hoisting state, bringing the fourth load to a ground surface, and detaching the fourth load from the hoisting wire.

21. The Method according to claim 17, further comprising the steps of prior to moving the first mast tilting member into the tilted hoisting state:

pulling a strut upwards parallel to the first mast lower part along a strut guide comprised by the first mast lower part, by winding a guywire which is attached to the strut, on a winch, until the strut reaches a strut positioning element, wherein the guywire is a first strut guywire which is attached to a second end of the strut and connected to an upper end of the first mast upper part;

pivoting the strut around the strut positioning element until the strut is in a functional position, by winding the guywire further on the winch; and winding the first strut guywire on a winch until the first strut guywire is tensioned for keeping the first mast upper part in a fixed position relative to the first mast lower part when the first mast tilting member is in the tilted hoisting state.

22. The Method according to claim 17, wherein the step of arranging the crane at the hoisting position includes arranging the second mast, which comprises a plurality of second mast sections, and a second mast tilting member which is arranged between two of the second mast sections, thereby defining a second mast upper part and a second mast lower part of the second mast, wherein the method further comprises the following steps:

assembling the second mast with the second mast tilting member in a straight hoisting state in which the second mast upper part and the second mast lower part are essentially in line with each other, and moving the second mast tilting member from the straight hoisting state into a tilted hoisting state in which the second mast upper part is tilted with respect to the second mast lower part and away from the first mast.

23. A Method for operating a crane, the method comprising the following steps:

arranging a crane at a hoisting location, which crane comprises a crane base, a first mast which comprises a plurality of first mast sections and is one of the back mast and the main boom, and a second mast which is the other one of the back mast and the main boom, wherein the first mast comprises a first mast tilting member which is arranged between two of the first mast sections, thereby defining a first mast upper part and a first mast lower part of the first mast;

assembling the first mast with the first mast tilting member in a tilted hoisting state in which the first mast upper part is tilted with respect to the first mast lower part and away from the second mast; and moving the first mast tilting member from the tilted hoisting state into a straight hoisting state in which the first mast upper part and the first mast lower part are essentially in line with each other.

* * * * *